US008556609B2

(12) United States Patent
Morselli

(10) Patent No.: US 8,556,609 B2
(45) Date of Patent: Oct. 15, 2013

(54) GEARED HYDRAULIC APPARATUS

(75) Inventor: Mario Antonio Morselli, Modena (IT)

(73) Assignees: Mario Antonio Morselli, Modena (IT); Settima Meccanica S.r.l, Settima (IT)

( * ) Notice: Subject to any disclaimer, the term of this patent is extended or adjusted under 35 U.S.C. 154(b) by 723 days.

(21) Appl. No.: 12/531,136

(22) PCT Filed: Mar. 14, 2008

(86) PCT No.: PCT/IB2008/050973

§ 371 (c)(1),
(2), (4) Date: Sep. 14, 2009

(87) PCT Pub. No.: WO2008/111017

PCT Pub. Date: Sep. 18, 2008

(65) Prior Publication Data

US 2010/0104463 A1 Apr. 29, 2010

(30) Foreign Application Priority Data

Mar. 14, 2007 (IT) ..... BO2007A0172

(51) Int. Cl.

| | |
|---|---|
| ***F01C 21/00*** | (2006.01) |
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl.
USPC ..... 418/189; 418/201.1; 418/201.3; 74/462

(58) Field of Classification Search
USPC ..... 418/189, 190, 201.1, 201.3, 206.1, 418/206.5; 74/462
See application file for complete search history.

(56) References Cited

U.S. PATENT DOCUMENTS

| | | | | |
|---|---|---|---|---|
| 2,159,744 | A * | 5/1939 | Maglott | 418/201.3 |
| 2,462,924 | A | 3/1949 | Ungar | |
| 2,471,149 | A * | 5/1949 | Girz | 418/189 |
| 2,869,473 | A * | 1/1959 | Kreamer | 418/189 |

(Continued)

FOREIGN PATENT DOCUMENTS

| | | | |
|---|---|---|---|
| EP | 0769104 A1 * | 4/1997 | |
| EP | 0 769 104 B1 | 9/1999 | |

(Continued)

OTHER PUBLICATIONS

Morselli, Mario Antonio, "Mechanical and Hydraulic Noise of Gear Pumps: The Drastic Evolution Marked by 'Continuous Contact' Pumps," *Oleodinamica Pneumatica*, Jan. 2005 (Part I) and Feb. 2005 (Part II), 19 pages.

*Primary Examiner* — Theresa Trieu
(74) *Attorney, Agent, or Firm* — Seed IP Law Group PLLC

(57) ABSTRACT

An improved geared hydraulic apparatus, comprising a pair of meshing gearwheels, mounted to be reciprocally rotatable in a casing between an inlet side and an outlet side for a fluid having, in use, a substantially transverse flow with respect to the axes of rotation of the gearwheels. The meshing gearwheels create, during their reciprocal rotation, progressive meshing configurations between respective co-operating teeth. In at least one of said progressive meshing configurations is defined, in at least one cross-section of the gearwheels, at least one closed area between respective fluid entrapment teeth. The closed area decreases until it is substantially cancelled out at and around at least one other, separate progressive meshing configuration between the aforesaid respective co-operating teeth.

12 Claims, 5 Drawing Sheets

(56) References Cited

U.S. PATENT DOCUMENTS

| | | | | |
|---|---|---|---|---|
| 2,885,965 | A * | 5/1959 | Haberland | 418/189 |
| 3,164,099 | A * | 1/1965 | Iyoi | 418/201.3 |
| 3,209,611 | A | 10/1965 | Iyoi | |
| 3,833,317 | A * | 9/1974 | Rumsey | 418/189 |
| 4,290,739 | A | 9/1981 | Korse | |
| 6,312,241 | B1 * | 11/2001 | Kamamoto et al. | 418/189 |
| 6,769,891 | B2 * | 8/2004 | Morselli | 418/201.3 |

FOREIGN PATENT DOCUMENTS

| | | | |
|---|---|---|---|
| EP | 1132618 | A2 | 9/2001 |
| EP | 1371848 | A1 * | 12/2003 |
| EP | 1 371 848 | B1 | 1/2006 |
| EP | 1852612 | A1 | 11/2007 |
| WO | 96/01950 | A1 | 1/1996 |
| WO | WO 9601950 | A1 * | 1/1996 |
| WO | 2006/090652 | A1 | 8/2006 |

* cited by examiner

GEARED HYDRAULIC APPARATUS

BACKGROUND OF THE INVENTION

The present invention relates to an improved geared hydraulic apparatus. The invention has been developed with particular reference to geared rotary positive displacement pumps, to which special reference will be made in the continuation of the present description, but the principles of the invention may also be applied in exactly the same way to geared hydraulic motors, which are therefore understood to be included within the scope of the present invention.

SUMMARY OF THE INVENTION

Geared rotary positive displacement pumps are generally constituted by two gearwheels, in the majority of cases of the spur gear type, one of which, known as the drive gear, is connected to a drive shaft and drives in rotation the other gearwheel, known as the driven gear. A particular drawback arising in the aforesaid geared pumps of conventional type, generally with involute tooth profile, is the fact that the pumped fluid is encapsulated, i.e. trapped, and compressed or in any case subjected to volume variations in the spaces enclosed between the profiles of the teeth in the meshing zone, thus giving rise to harmful and uncontrolled peaks of local stress which are the cause of direct operating noise. FIG. 1, purely by way of example, shows diagrammatically in cross-section the meshing zone of the two gearwheels 1 and 2 of a conventional type of geared hydraulic apparatus, in a specific angular position, in which the configuration of the respective meshing teeth 3 and 4 entails the generation of closed areas 5 and 6 in which the fluid is trapped. As can easily been seen in the drawing, the closed area 5, just formed in the course of the reciprocal rotation of the gearwheels 1 and 2, gradually decreases to the dimensions of the area 6, in order then to expand again until the rotation of the gearwheels causes the teeth of same to move away from one another on the opposite side from that of the closed area 5, thus interrupting the entrapment of fluid.

Besides the direct operating noise indicated above, there is also a known problem arising from the phenomenon of irregularity, or "ripple", in the transfer of the fluid which entails an indirect operating noise, known as ripple noise, linked to the flow rate pulsation and therefore pressure pulsation in the user circuit. In other words, the oscillations in the fluid flow rate generate a pulsating wave which, via the fluid itself, is transmitted to the surrounding atmosphere and, in particular, to the walls of the pump, to the pipework and to the delivery pipes. The induced noise may also reach unpredictable levels in the case where the aforesaid members resonate with the oscillation or ripple frequency. A series of studies and experiments have shown that such oscillations are intrinsically due to the configuration of the rotors or gearwheels of the above-mentioned pumps which, in consecutive phases of their meshing, produce a discontinuity in the variation of the volume which causes the transport of the fluid from intake to delivery. In order words, the ripple is due to the discontinuity in the variation of said volume with respect to time, or, rather, with respect to the reciprocal angular position of the rotors. The aforesaid phenomena are clearly and fully described in the articles by MORSELLI Mario Antonio, "*Mechanical and hydraulic noise in geared pumps", Oleodinamica Pneumatica*, January 2005, pp. 54-59, and February 2005, pp. 42-46, which also appeared in *Fluides & Transmissions*, No. 75, April 2005, pp. 34-37 and No. 77, May 2005, pp. 20-26.

Some solutions are known which have tackled, with greater or lesser success, the problems illustrated above.

Some of these solutions relate to pumps with conventional toothing, having tooth flank profiles, mostly, but not necessarily, that are involute, of the spur gear type or, more rarely, helical gear type, with clearance (that is, with single contact of a tooth of one gearwheel with a corresponding tooth of the other gearwheel) or theoretically without clearance (that is, with double contact, where both the flanks of the teeth are theoretically always in engagement, as in the pump from Bosch Rexroth AG known by the tradename SILENCE, or the pump from Casappa S.p.A. known by the tradename WHISPER). In these solutions, the fluid trapped between the teeth is, at least in part, "discharged", that is, evacuated, via suitable undercuts or pockets or ducts provided on the faces of the lateral abutment means, otherwise known as supports or bushes, of the gearwheels, that is, on the walls which face the flat lateral gearwheel ends, and which make it possible to discharge (or aspirate) the encapsulated volume of fluid towards the appropriate, respectively high or low pressure, port or gate.

The provision of the pockets on the faces of the lateral abutment means, however, becomes much more complex when it is wished to produce helical gearwheels in order to reduce the problem of ripple noise. Moreover, the adoption of helical gearwheels in itself presents a series of additional problems, since in this case the volume of each fluid entrapment area also extends, like the teeth of the gearwheels, on a worm-like helical course over the entire width of the gearwheel, therefore representing a potential communication route or by-pass between the intake and delivery, if particular stratagems were not adopted. In other words, the areas 5 and 6 of FIG. 1, which in the plane of the drawing are clearly "trapped" between the profiles of the two gearwheels 1 and 2, in the case of helical gearwheels proceed helically in space: with a high helix angle the high pressure zone of the pump would be connected to the low pressure zone. In practice, either small helix angles of the gearwheels are adhered to, or solutions that are very complex and expensive from the constructional point of view are adopted, such as that described in the document EP-0769104 of Brown David Hydraulics Ltd., in which the gearwheels have, for each of their cross-sections, at least two teeth simultaneously in engagement. Such solutions, however, are very complex and not very efficacious in substance, since they are developed on the basis of concepts that are closer to mathematical abstractions than to practical and technologically feasible possibilities; in practice, the geometry of said pockets is always a not completely satisfactory compromise.

In any case, all the known pump solutions, whether of the spur or helical gear type, single or double contact, which employ discharge pockets on the lateral abutment means have however a residual trapped volume which is subject to variations which cannot be discharged, and which therefore generate a certain residual noise, besides having a significant and harmful ripple.

Other known solutions to the problems of direct and indirect noise mentioned above relate to pumps with toothing having a non-conventional profile, which may be defined as "with continuous contact", which do not trap fluid between the head and bottom of the tooth. In practice, the gearwheels meshing with one another have profiles having a rounded appearance at the head of the tooth and a theoretical single point of contact which moves continuously from one flank of the gearwheel to the other, in such a way as never to generate any closed area of fluid entrapment during meshing, over the entire width of the gearwheels. This principle, theoretically stated in broad terms and quite generally in the documents U.S. Pat. No. 2,159,744, U.S. Pat. No. 3,164,099, U.S. Pat. No. 3,209,611, which has, however, never found any practical application, has been fully developed and described in the documents EP-A-1132618, EP-B-1371848, U.S. Pat. No. 6,769,891 of the same inventor and joint Applicant of the present application, as well as in the technical articles mentioned above, and has found a practical application in the pump known by the tradename Continuum® Settima Flow Mechanisms. The toothing types developed by the present inventor do not have a by-pass between intake and delivery of the pump, have minimum pulsation of the fluid and a notable quietness of meshing. This last solution, although it has proved to be clearly superior from the point of view of quietness compared with conventional pumps, has however the drawback of a slightly lower volumetric output than that of the known pump solutions in which there is fluid entrapment. The principal reason lies in the modest tooth height that can be produced with a profile designed according to the concept of "non-encapsulation", and therefore a corresponding modest effective flow rate per unit of volume, with the same number of teeth. In order to have effective unitary flow rates, comparable with those of the pumps with encapsulation, a small number of teeth may be adopted, but this entails greater volumetric losses because of the reduced seal between high pressure delivery and low pressure intake, since the teeth also function as labyrinth seals.

All the problems discussed above are increased in the case of hydraulic apparatuses intended to operate with high pressure differentials, for example in the case of geared pumps for pressure differentials greater than a few tens of bars, and even more for pressures greater than 80-100 bars.

It is therefore an aim of the present invention to provide a geared hydraulic apparatus which remedies the drawbacks of the prior art, and in particular which considerably reduces the noise compared with conventional apparatuses with fluid encapsulation, substantially approaching the quietness of the apparatuses without encapsulation, but providing a better volumetric output than these latter, without all this entailing significant increases in the cost and/or complexity of production compared with the commercially more widely used solutions. A further aim of the invention is that of providing a geared hydraulic apparatus which has good sealing characteristics, is simple and economical to manufacture and maintain, and is very reliable over time even for demanding applications, and in particular for high performance with high pressure differentials.

In order to achieve the aims mentioned above, the subject of the invention is an improved geared hydraulic apparatus, comprising a pair of meshing gearwheels, mounted to be reciprocally rotatable in a casing between an inlet side and an outlet side for a fluid having, in use, a substantially transverse flow with respect to the axes of rotation of the gearwheels, the meshing gearwheels creating, during their reciprocal rotation, progressive meshing configurations between respective co-operating teeth, there being defined, in at least one of said progressive meshing configurations, in at least one cross-section of the gearwheels, at least one closed fluid entrapment area between respective teeth, said closed fluid entrapment area decreasing until it is substantially cancelled out at and around at least one other, separate, progressive meshing configuration between the aforesaid respective co-operating teeth.

According to a particular aspect of the present invention, the geared hydraulic apparatus is a geared rotary positive displacement pump. In a pump of this type, the possibility of fluid encapsulation makes it possible to adopt a higher proportion of teeth than in the type of solutions with continuous contact of the prior art developed by the same inventor, therefore improving the output thereof.

According to another particular aspect of the present invention, the geared hydraulic apparatus is a hydraulic motor.

In a particular embodiment, the gearwheels are helical. In this case, it is possible to adopt even a significant helix angle without there being a risk of by-pass between inlet and outlet, i.e. in particular between intake and delivery in the case of positive displacement pumps. The helical toothing makes it possible to minimise the noise due to meshing, which is instead characteristic of straight-cut toothing because of the non-gradual passage of the contact from one pair of teeth to the next between the co-operating teeth of the gearwheels. The helical toothing further makes it possible to minimise the delivery pulsation of the fluid, and therefore the ripple noise. The overlap of the helical toothing may preferably be equal or close to unity.

The hydraulic apparatus of the present invention may have undercuts or pockets or ducts provided on the faces of the lateral abutment means or supports or bushes of the gearwheels, arranged in communication with the closed fluid entrapment areas which form in the aforesaid meshing configurations at the end cross-sections of the gearwheels, in order to discharge the trapped fluid towards the appropriate high or low pressure side, port or gate. The dimensioning of said discharge pockets is simple and optimum, since the by-pass between the inlet side and the outlet side is prevented by the toothing itself, in the meshing configuration in which the closed fluid entrapment area is substantially reduced to zero and there is a substantial absence of clearance between the tooth head of one gearwheel and the tooth bottom of the other gearwheel.

Obviously, the "absence of clearance" referred to here is to be understood as such as to guarantee a fluid sealing function, even if it is not ruled out that there may be a certain "operating" clearance between the gearwheels, suitable for guaranteeing correct mechanical functioning.

In particular embodiments, the hydraulic apparatus of the present invention will preferably be provided with a number of teeth ranging between 5 and 15, more preferably between 5 and 14, more preferably between 5 and 13, more preferably between 6 and 12, more preferably between 6 and 11, more preferably between 6 and 10, more preferably between 6 and 9, even more preferably between 7 and 9, and most preferably with a number of teeth equal to 8.

In particular embodiments, the hydraulic apparatus of the present invention will preferably have a ratio of the magnitudes of face width to pitch diameter of between 0.5 and 2, more preferably between 0.6 and 1.7, more preferably between 0.7 and 1.5, more preferably between 0.8 and 1.3, more preferably between 0.85 and 1.2, even more preferably between 0.9 and 1.1, and most preferably close to unity.

BRIEF DESCRIPTION OF THE DRAWINGS

Other features and advantages of the invention will become clear from the following detailed description which is given with reference to the appended drawings which are provided purely by way of non-limiting example and in which.

DETAILED DESCRIPTION OF THE INVENTION

Although the following discussion is provided with reference to a pump, identical reasoning and considerations may be applied to similar hydraulic motors.

Figure 2:
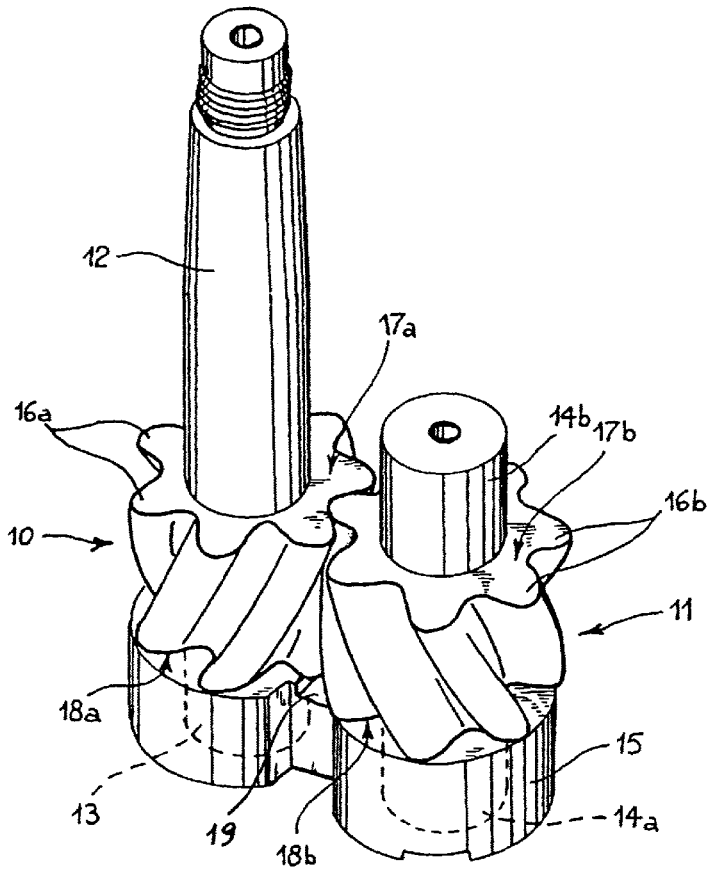
FIG. 2 shows in perspective a pair of meshing gearwheels of a positive displacement pump according to the present invention, mounted to be rotatable on a lateral support and abutment bush.

With reference to FIG. 2, a rotary positive displacement pump of the type with transverse flow comprises a first and a second gearwheel or rotor 10, 11. The first gearwheel 10 is connected, integrally or by means of a type of fixing generally known in the field, to a drive shaft 12 which, when the pump is in use, receives the motion from a drive member (not shown). The second gearwheel 11 meshes with the first gearwheel and, in use, is driven in rotation by this latter. Both the gearwheels 10, 11 are provided with stubs or shafts 13, 14*a*, 14*b* mounted to be rotatable, like the drive shaft 12, in a sealed manner on abutments or bushes 15, only one of which is shown in FIG. 2 for clarity of illustration. The gearwheels 10, 11 are enclosed, as is well known in the field of rotary pumps, in a casing (not shown) provided with an intake port and a delivery port for the fluid to be pumped.

The fluid is transferred from one port to the other (depending on whether a pump or a hydraulic motor is involved) in a substantially transverse direction with respect to the axes of rotation of the gearwheels.

Each gearwheel 10, 11 has a series of peripheral teeth 16*a*, 16*b* of identical profile and in number such that, with respect to the helix angle, the meshing and the entrainment of the driven gearwheel 11 by the drive gearwheel 10 can be guaranteed in any angular position. Preferably, the number of teeth will range between 5 and 15, more preferably between 5 and 14, more preferably between 5 and 13, more preferably between 6 and 12, more preferably between 6 and 11, more preferably between 6 and 10, more preferably between 6 and 9, even more preferably between 7 and 9, and most preferably the number of teeth of each gearwheel will be equal to 8.

The teeth 16*a*, 16*b* extend helically over the height of each gearwheel 10, 11 with face overlap substantially equal or close to unity, that is to say, in other words, with axial pitch between two consecutive teeth equal or close to the height of the gearwheel in the direction of the axis of rotation. Owing to this configuration, the transverse profile of a tooth 16*a* or 16*b* at an end face 17*a*, 17*b* of the gearwheels 10, 11 is substantially aligned—in a direction parallel to the axis of rotation of the gearwheels themselves—with the transverse profile of an adjacent tooth 16*a*, 16*b* at the other end face 18*a*, 18*b* of the respective gearwheel 10, 11.

The pump of the present invention will preferably have a ratio of the magnitudes of face width to pitch diameter of between 0.5 and 2, more preferably between 0.6 and 1.7, more preferably between 0.7 and 1.5, more preferably between 0.8 and 1.3, more preferably between 0.85 and 1.2, even more preferably between 0.9 and 1.1, and most preferably close to unity.

Figure 1:
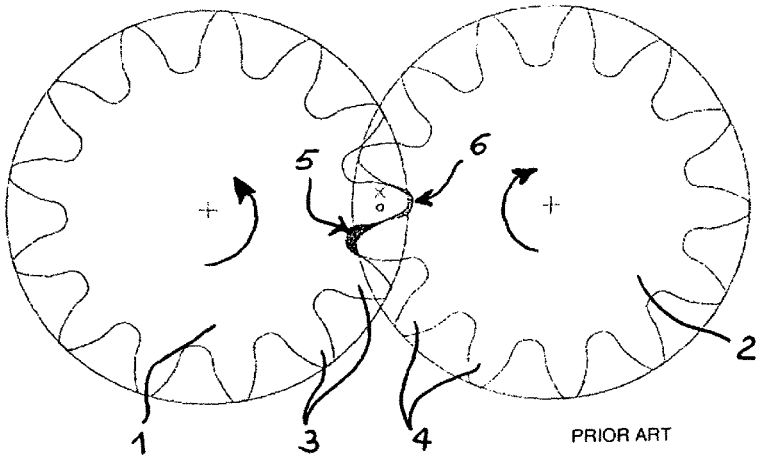
FIG. 1, already discussed in the preamble of the present description, illustrates profiles of meshing teeth of gearwheels of pumps of the prior art, which involve fluid encapsulation in any meshing configuration.
Figure 3:
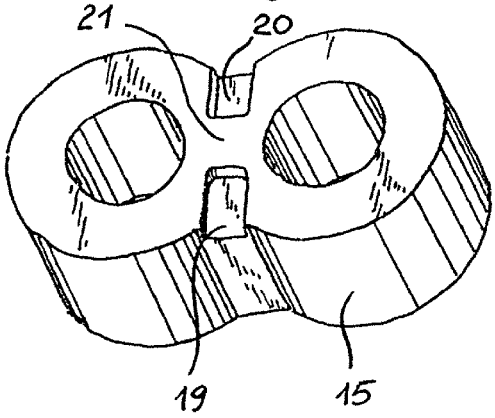
FIG. 3 shows in perspective on an enlarged scale the lateral support and abutment bush of FIG. 2.

On each lateral support and abutment bush 15 of the gearwheels 10, 11, undercuts or pockets or ducts 19, 20 are provided (see also FIG. 3) which lead respectively to the delivery side and the intake side of the pump and place in communication therewith the fluid entrapment areas between the teeth of the gearwheels 10, 11 which will be discussed hereinafter, in order to allow the fluid trapped between the teeth to be expelled gradually and uniformly from said entrapment areas. As can easily be seen in FIG. 3, the two undercuts 19, 20 of the lateral bush 15 are separated by a sealing zone 21 on which the meshing teeth 16*a*, 16*b* of the gearwheels 10, 11 slide in a sealed manner. The sealing zone is arranged, as will be understood more clearly hereinafter, at an angular meshing position between the teeth 16*a*, 16*b* of the gearwheels 10, 11 devoid of entrapment or encapsulation of fluid.

Figure 4:
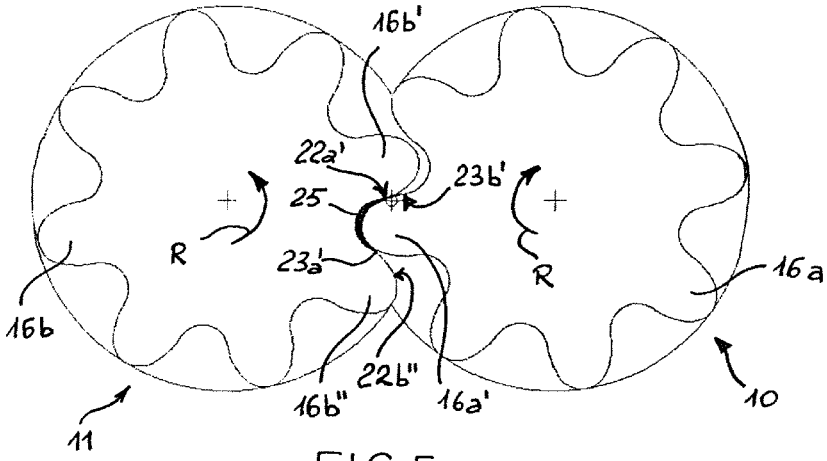
FIG. 4 is a cross-section of the gearwheels of FIG. 2, in a first angular meshing position.
Figure 5:
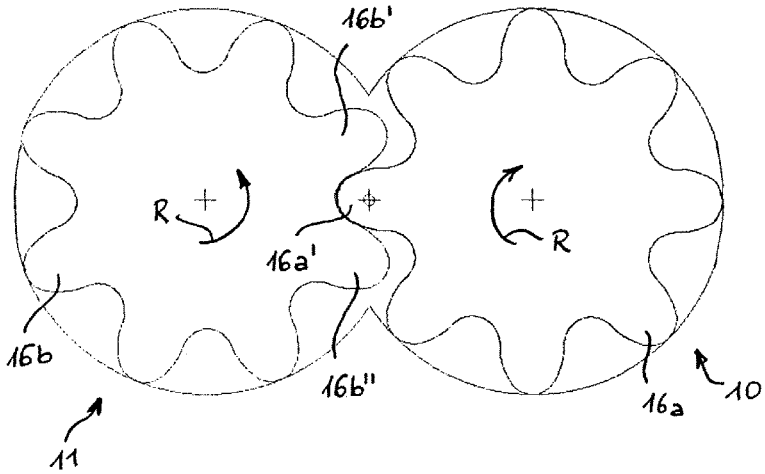
FIG. 5 is a section similar to that of FIG. 4, showing the pair of gearwheels in a second angular meshing position.
Figure 6:
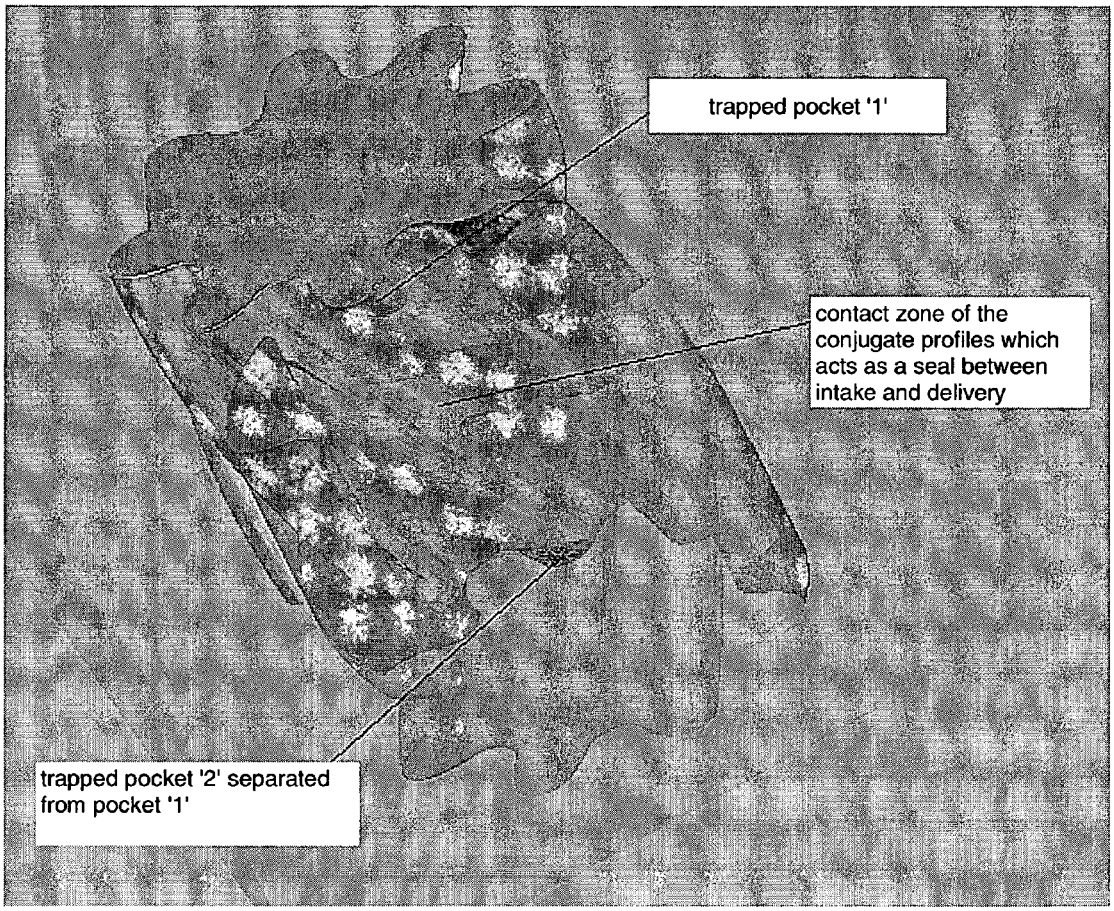
FIG. 6 shows in partially transparent perspective two meshing gearwheels according to the present invention, wherein it is evidenced a contact zone of the conjugate profiles which acts as a seal between intake and delivery, and also two pocket zones, separated one from the other, where a quantity of fluid is trapped.
Figure 7:
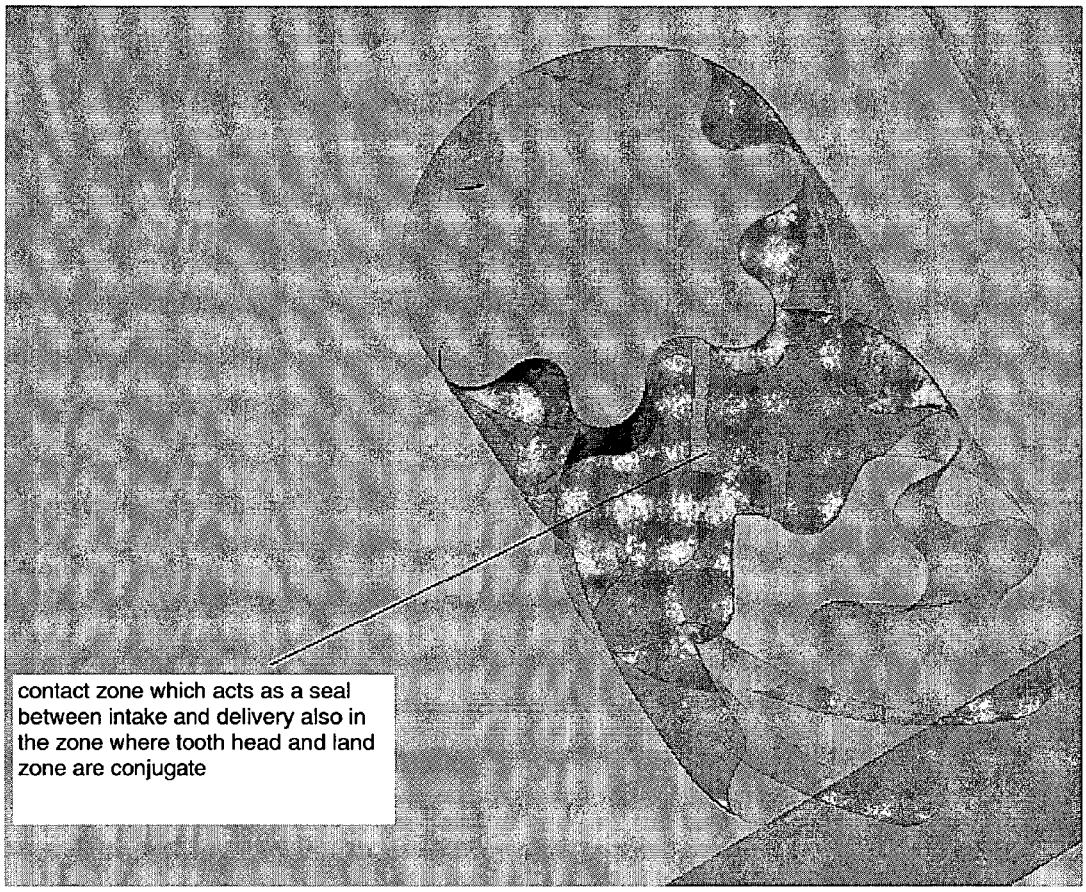
FIG. 7 shows in partially transparent perspective two meshing gearwheels according to a solution of the prior art with no encapsulation at all, according to the teachings of patents EP 1132618, EP 1371848, U.S. Pat. No. 6,769,891 of the same inventor.

FIGS. 4 and 5 show, in cross-section with respect to the axis of rotation of the gearwheels 10, 11, the positions assumed by the teeth 16*a*, 16*b* in two consecutive instants of meshing during the rotation of the gearwheels according to the arrows R. One of the teeth 16*a*' of the gearwheel 10 meshes with a corresponding tooth 16*b*' of the gearwheel 11 and its front flank 22*a*' comes into contact with the rear flank 23*b*' of the corresponding tooth 16*b*', urging it in rotation. The rotation of the gearwheel 11 brings the rear flank 23*a*' of the tooth 16*a*' to touch the front flank 22*b*" of the tooth 16" angularly adjacent to the tooth 16*b*'. It appears obvious that in this situation a closed area 25 will be created between the head of the tooth 16*a*' of the gearwheel 10 and the bottom land between the teeth 16*b*' and 16*b*" of the gearwheel 11, in which a certain amount of fluid will be trapped. During the rotation of the gearwheels 10, 11 according to the arrows R, the configuration of the teeth 16*a*, 16*b*, rounded at the head and bottom tooth zones, causes the closed area 25 to decrease gradually until it is cancelled out around a consecutive angular position of the gearwheels 10, 11 illustrated in FIG. 5. In that configuration, the head of the tooth 16*a*' of the gearwheel 10 mates substantially, except for machining tolerances and operating clearances, with the bottom land between the teeth 16*b*' and 16*b*" of the gearwheel 11, with substantial elimination of the fluid encapsulation zone and the creation, over the entire width of the gearwheels, of a sealing zone between the delivery and intake.

The fluid which, over the width of the gearwheels, is trapped between the teeth 16*a*' and 16*b*' in the closed area 25 (and in the corresponding closed area which forms between the teeth 16*a*' and 16*b*", and their like, in angular meshing positions consecutive to that of FIG. 5) may be dumped effectively into the undercuts 19 (and 20) of the abutments or bushes 15, without there being any by-pass between the delivery and intake zones of the pump, owing to the seal obtained by the mating configuration of the profiles of the gearwheels between head and root of the teeth. In the same way, however, the possibility of producing a fluid entrapment zone between the two sets of teeth permits proportioning in which the teeth may be taller than the teeth of known toothing with continuous contact without encapsulation, in such a way as to be able to use a greater number of teeth than these latter pumps, with consequent improvements from the point of view of output.

In practice, the profiles of the teeth of the gearwheels 10 and 11 may be determined experimentally or analytically. In the preferred embodiment of the invention, the transverse contact ratio is less than the unity and, even more preferably, although not limiting, is comprised between 0.55 and 0.80.

The present invention is particularly advantageous when used with pressure differentials between intake and delivery that are greater than a few tens of bars, more particularly greater than around 50 bars, and even more particularly greater than around 80-100 bars.

Naturally, with the principle of the invention remaining the same, the forms of embodiment and details of production may vary widely with respect to those described and illustrated, without thereby departing from the scope of the present invention.

The invention claimed is:

1. An improved geared hydraulic apparatus, comprising a pair of meshing gearwheels, mounted reciprocally rotatable in a casing, the gearwheels having helical toothing, said casing having an inlet and an outlet for the passage of a fluid which flows in a direction transverse to the axes of rotation of the gearwheels, the fluid flowing substantially transversally alone the meshing gearwheels when said gearwheels rotate, the meshing gearwheels presenting, during their reciprocal rotation, different meshing configurations, wherein in at least one of said meshing configurations, a closed fluid entrapment area between two meshing teeth of the meshing gearwheels is formed, said closed fluid entrapment area being entirely cancelled out in one of a progressive meshing configurations, so that in the latter meshing configuration an absence of any area entrapping fluid between a tooth head of one gearwheel and a tooth bottom of the other gearwheel is achieved.

2. A hydraulic apparatus according to claim 1, wherein the hydraulic apparatus is a geared rotary positive displacement pump.

3. A hydraulic apparatus according to claim 1, wherein the hydraulic apparatus is a hydraulic motor.

4. A hydraulic apparatus according to claim 1, wherein the gearwheels present their teeth with a top land rounded and without edges.

5. A hydraulic apparatus according to claim 4, wherein the overlap of the helical toothing is equal or close to unity.

6. A hydraulic apparatus according to claim 1, comprising undercuts provided on faces of bushes of the gearwheels, arranged in communication with the closed fluid entrapment areas, for discharging the trapped fluid towards the appropriate high or low pressure side, port or gate.

7. A hydraulic apparatus according to claim 1, wherein each gearwheel comprises a number of teeth ranging between 5 and 15.

8. A hydraulic apparatus according to claim 1, wherein a ratio of the magnitudes of face width to pitch diameter for each gearwheel is between 0.5 and 2.

9. An improved geared hydraulic apparatus, comprising a pair of meshing gearwheels, mounted reciprocally rotatable in a casing, said casing having an inlet and an outlet for the passage of a fluid which flows in a direction transverse to the axes of rotation of the gearwheels, the meshing gearwheels presenting, during their reciprocal rotation, different meshing configurations, wherein in at least one of said meshing configurations, a closed fluid entrapment area between two meshing teeth of the meshing gearwheels is formed, said closed fluid entrapment area being entirely cancelled out in one of a gearwheel and a tooth bottom of the other gearwheel is achieved, and wherein each gearwheel comprises a number of teeth equal to 8.

10. An improved geared hydraulic apparatus, comprising a pair of meshing gearwheels, mounted reciprocally rotatable in a casing, said casing having an inlet and an outlet for the passage of a fluid which flows in a direction transverse to the axes of rotation of the gearwheels, the meshing gearwheels presenting, during their reciprocal rotation, different meshing configurations, wherein in at least one of said meshing configurations, a closed fluid entrapment area between two meshing teeth of the meshing gearwheels is formed, said closed fluid entrapment area being entirely cancelled out in one of a progressive meshing configurations, so that an absence of clearance between a tooth head of one gearwheel and a tooth bottom of the other gearwheel is achieved, and wherein a ratio of the magnitudes of face width to pitch diameter for each gearwheel is close to unity.

11. A pair of helical gearwheels for use in a hydraulic apparatus, said gearwheels being rotatable about their respective rotational axes, said rotational axes being parallel to each other, each gearwheel comprising teeth that mesh with the teeth of the other gearwheel during their respective rotations, said teeth having their top land rounded and without edges and having profiles that are configured in at least a section perpendicular to said rotation axes in such a way that a progressive meshing of a first tooth of a first gearwheel with a second tooth of a second gearwheel determines in a first meshing configuration the contact of a front flank of the first tooth with a rear flank of the second tooth, in a second meshing configuration a rear flank of the first tooth is in touch with a front flank of a third tooth of the second gearwheel, said third tooth being angularly adjacent to the second tooth, so that a closed area is created between the head of the first tooth and the bottom area between the second tooth and the third tooth of the second gearwheel, during the progressive rotation of the gearwheels the configuration of the teeth being so that the closed area decreases progressively until it is cancelled out in a position of the gearwheels in which the head of the first tooth of the first gearwheel mates with the bottom area between the second tooth and the third tooth of the second gearwheel, so as to create, in use, an effective seal preventing the passage of fluid from a high pressure zone to a low pressure zone.

12. The pair of helical gearwheels according to claim 11, comprising undercuts provided on faces of bushes of the gearwheels, communicating with the closed fluid entrapment areas, for discharging the trapped fluid towards the appropriate high or low pressure side before the closed area is cancelled out.

* * * * *